United States Patent [19]

Nancarrow

[11] 4,358,185

[45] Nov. 9, 1982

[54] OPTICAL PRINTING AND TYPESETTING MACHINERY

[75] Inventor: Peter H. Nancarrow, Girton, England

[73] Assignee: Rachel M. Nancarrow, Girton, England

[21] Appl. No.: 294,008

[22] Filed: Aug. 18, 1981

Related U.S. Application Data

[63] Continuation of Ser. No. 39,132, May 5, 1979, abandoned, which is a continuation of Ser. No. 664,686, Mar. 8, 1976, abandoned.

[30] Foreign Application Priority Data

Mar. 11, 1975 [GB] United Kingdom ..... 10024/75
Oct. 7, 1975 [GB] United Kingdom ..... 40902/75

[51] Int. Cl.[3] ..... B41B 17/00
[52] U.S. Cl. ..... 354/13; 354/12
[58] Field of Search ..... 354/5–19

[56] References Cited

U.S. PATENT DOCUMENTS 3,701,999 10/1972 Congleton et al. ..... 354/5
3,703,137 11/1972 Anderson et al. ..... 354/5

OTHER PUBLICATIONS

"Ideographic Composing Machine," W. F. Heagerty, *Applied Optics*, Oct. 1970, pp. 2291–2294.

*Primary Examiner*—Russell E. Adams
*Attorney, Agent, or Firm*—Brisebois & Kruger

[57] ABSTRACT

An ideographic optical typesetting machine employs a stationary character matrix comprising 10,000 holograms, a laser light source and a beam deflector system enabling light from the laser to be scanned over the matrix. The holograms are so recorded that when scanned by the beam they cause an image to be reconstricted in a common location, where a suitable receptor is located. As described each image contains more than one print symbol, and the receptor is shiftable to receive any one of those symbols as required. In all 250,000 print symbols are stored on the matrix. Additionally, each image includes code signals for the control of scanning and exposure time.

21 Claims, 3 Drawing Figures

OPTICAL PRINTING AND TYPESETTING MACHINERY

This is a continuation, of application Ser. No. 039,132, filed May 5, 1979; which was a continuation of application Ser. No. 664,686, filed Mar. 8, 1976 both now abandoned.

BACKGROUND OF THE INVENTION

This invention relates to optional printing and typesetting machinery for ideographic writing systems. It is characteristic of such systems that they require a very large vocabulary of graphically distinct items and the provision of automatic machinery to handle such large vocabularies represents a considerable technical problem. In the case of the Chinese language, which will be used as an example in the present specification, the very minimum vocabulary is above 2,000 items, while a total repertoire of some 40,000 items, some of which are admittelly of very rare occurence, could be achieved. A rotary stroboscopic printer for 5,000 characters has been proposed, but complicated justifying arrangements are needed to correct the position of characters lying in different circular bands on the rotating disc, and the output is limited as to type face. Alternative techniques involve computer storage of drawing specifications for a set of Chinese characters, but this requires large quantities of digital storage for even a single very primitive style of character.

A relatively recent development in information storage has been the use of holograms, in which information is stored in the form of optical diffraction patterns. A few tentative proposals have been made in the direction of storing alphanumeric symbols in this way and reconstructing them by illumination with monochromatic radiation, for example laser illumination. However, the arrangements proposed have not been suitable either for handling very large vocabularies, such as are required for ideographic scripts, or for providing the necessary degree of resolution for typesetting work.

SUMMARY OF THE INVENTION

The present invention has for its object the utilisation of holographic storage methods to produce images of high resolution from a stock of the order of magnitude required in handling ideographic writing systems. In the fulfilment of this object the invention relates both to optical printing and typesetting machines and also to holographic character matrices for use in such machines.

According to the present invention an optical printing or typesetting machine comprises in combination a source of substantially monochromatic radiation, a deflector system arranged to deflect radiation emanating from the source, a character matrix occupying a fixed location relative to the source and deflector system and comprising a plurality of holograms each of which when illuminated by radiation emergent from the deflector system causes a character image to be reconstructed at a common image field, and receptor means arranged to receive images produced at the common image field and arrange them as required to produce a desired printed output.

Holographic character matrices according to the present invention may include more than one image per individual hologram, and may include position control signals and exposure control means. Apparatus according to the invention will be described in which image selection and feedback control means are provided to exploit such matrices.

DESCRIPTION OF THE PREFERRED EMBODIMENT

Figure 1:
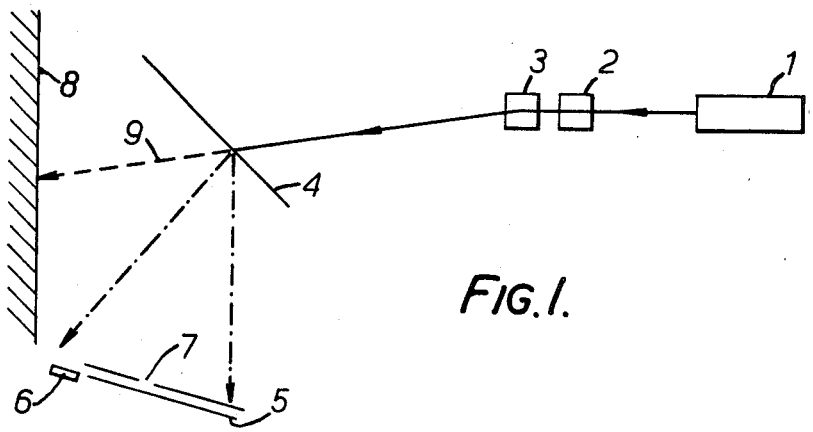
FIG. 1 is a diagrammatic view of the basic components of an optical typesetting machine according to the invention.

The machine illustrated in FIG. 1 includes a laser 1 mounted in a fixed position to project a beam of coherent light 2 mm in diameter towards an X, Y deflector system consisting of a pair of mirrors 2, 3. A character matrix 4 occupies a fixed position in the machine which position is so chosen that light emerging from the mirrors 2, 3 can be scanned over the entire matrix by movement of these latter.

The character matrix consists of a rectangular array of individual holograms each of which relates to a respective character. The process of forming these holograms involves presenting the images to be stored at a fixed location and in each instance recording the holographic pattern at a corresponding position in the array. The geometry of the recording process is so related to the deflector system of FIG. 1 that, when the matrix is in register as shown, the illumination of any of the individual holograms results in the reconstruction of an undistorted real image at a common image field whose position relative to the matrix is analagous to that of the original image during the recording process. In this way the linear and angular relationship between each original image and its hologram is preserved in the latter and the fact that the beam from the laser 1 has to be deflected through a large solid angle does not result in distortion or de-focusing. In the illustrated machine a photographic film is arranged to be supported at 5, in the plane of the common image field. A group of photosensitive deflectors 6 is located to one side of the image field to accept control signals as will be described below in greater detail. A shutter indicated diagrammatically at 7 permits controlled exposure of the film 5 to a given image in the field, while a blackened surface 8 is disposed to absorb undiffracted light 9 emerging from the matrix 4.

The film 5 is supported conventionally for composing movement, and it will be understood that it can therefore accept images generated selectively by adjustment of the mirrors 2 and 3 to illustrate any of the individual holograms which make up the matrix, thereby compiling a film master.

The arrangement described above is designed as a Chinese character typesetter having a vocabulary of 10,000 characters, represented in five type faces and five point sizes. The total number of symbols recorded is thus 250,000. The matrix 4 consists of 10,000 individual holograms set out in a square array. Each individual hologram is recorded in a circular area of 2 mm diameter, and the centre-to-centre distance between adjacent rows and columns of holograms is 3 mm.

Figure 2:
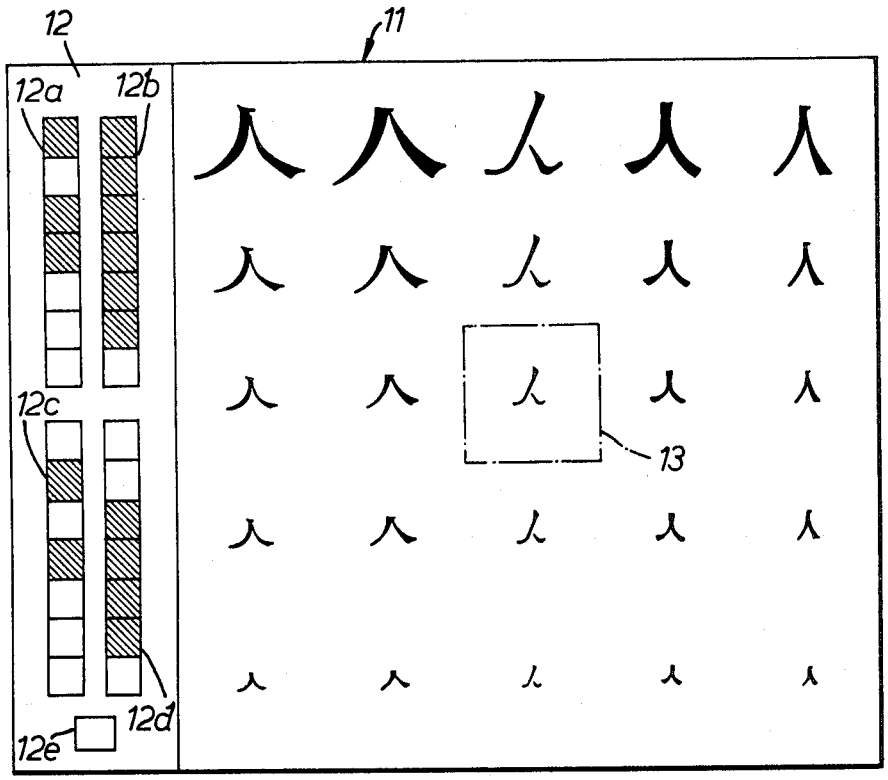
FIG. 2 is a layout of the image stored in an individual hologram of a character matrix according to a preferred embodiment of the invention.

A typical example of the image stored in an individual hologram is shown in FIG. 2 which represents the image recorded in respect of the character "λ". The image 11 includes the twenty five versions of this character in a standard 5×5 array in which each row corresponds to a given point size and each column represents a given type face. At the left hand side of the image is a code symbol area 12, containing code symbols determined as follows. The upper 7.digit panels 12*a*, 12*b* represent the X and Y co-ordinates of the location on the matrix 4 of the hologram which stores the image 11. The lower 7-digit panels 12*c*, 12*d* represent numbers smaller than the respective X and Y co-ordinates by a pre-determined amount. In the drawing the X and Y co-ordinates are (13,63) in decimal notation, while the numbers in 12*c* and 12*d* are (10,60). A blank area 12*e* may be used for exposure evaluation.

As discussed above, illumination of any of the individual holograms by light emerging at the correct angle from the deflector system 2, 3 will result in the whole of the corresponding image being reconstructed at the film plane 5. A bodily shift of the file transport machanism can then be used to locate the shutter 7 to accept any one of the cells of the 5×5 array of characters, thus selecting the appropriate style and size for a printing operation. In FIG. 2 a dotted FIG. 3 indicates the relative location of the shutter 7 to pass the middle point size of the third type face. The photodetectors 6 which detect the code areas 12 must obviously not move during such a selection, since the image field is not shifted. To avoid difficulties in accommodating the shift of the film, it is possible to arrange that its code symbol occupies a plane nearer the matrix than the portion containing the characters.

Figure 3:
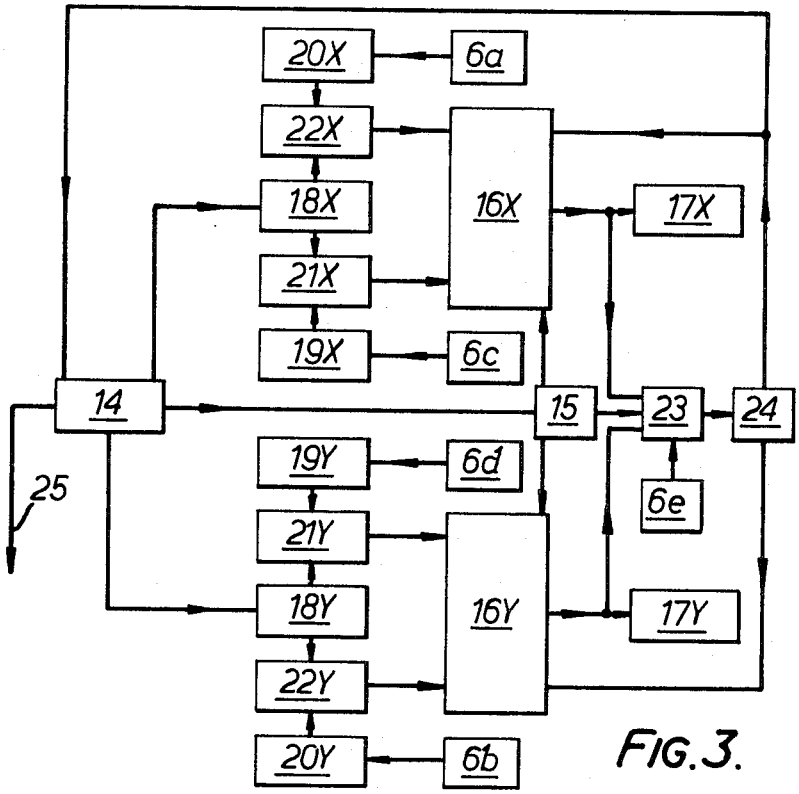
FIG. 3 is a block schematic drawing of the control circuit of the machine of FIG. 1.

Turning now to the control of character selection in the machine shown in FIG. 1, the control circuitry is illustrated schematically in FIG. 3. The control is effected from a punched tape record of (X,Y) co-ordinates, produced in a suitable keyboard, the tape being passed through a reader 14. If desired an extra binary digit in the coding system will allow a parity check to be exercised at this point. The output from the reader 14 passes firstly to trigger a clock pulse generator 13 which feeds timed pulses to X and Y motor drives 16X, 16Y which in turn drive stepping motors 17X, 17Y connected to the mirrors 2, 3 respectively.

The X and Y signals from the reader 14 pass to respective registers 18X and 18Y, and the contents of these registers are compared with the contents of further registers 19X, 19Y, 20X and 20Y, which contain the signals (12*c*, 12*d*, 12*a*, 12*b*) from the detectors 6*c*, 6*d*, 6*a* and 6*b* respectively, at corresponding null detectors 21X, 21Y, 22X and 22Y. The outputs from the null detectors 21X and 21Y serve to bring into operation frequency-dividing circuits in the respective drives 16X and 16Y to reduce the stepping rate and thereby slow the motors in advance of their final stopping position. The outputs from the null detectors 22X and 22Y then serve to stop the drive so that the motors come to rest with the mirrors 2 and 3 so adjusted that the co-ordinates of the illuminated holograms are those which have been read from the punched tape by the reader 14. The shutter 7 is driven by a shutter drive 23 which registers when both motor drives have stopped. The exposure time is controlled by the output of a photodetector 6*e* which measures the intensity of the portion 12*e* of the selected image. When the shutter 7 has closed, a signal passes from the shutter drive 23 to a reset circuit 24 which causes the drives 16X, 16Y to bring the motors 17X, 17Y to their starting positions and steps on the reader 14. An output 25 from the reader 14 serves to pass coded typographic instructions to the film transport mechanism, both for selection of the required size and style of character and also for composing instructions.

The embodiment described above is only one example of the application of the present invention in practice, and many other arrangements could be adopted. Thus, although an optical feedback system with optional parity check has been described for error-free beam deflection, nevertheless a simple drive circuit without feedback could be used with sufficiently accurately driven motors, and exposure control could be omitted. Similarly, although stepping motors give the incremental motion required in this context, it may be possible to use other types of motor if feedback is employed. Alternatively, acousto-optic deflection could be employed.

Although the embodiment described has a completely stationary matrix, it would also be possible to realise the mounting of the matrix in a fixed location by securing it for rotation about a fixed centre and locating the individual holograms by reference to polar co-ordinates. One mirror only would then be needed to select the co-ordinate r, since the co-ordinate 0 could be stroboscopically determined at the instant when the required radial line of holograms passed a datum position for the first time after the mirror had been set. This technique would still use the inherent geometry of the holograms to reconstruct their images correctly at the given image field, and would employ continuous rotation to avoid the disadvantages of inertia inherent in intermittent movement of a large matrix. The control arrangement of the stroboscopic system would, of course, still require some shuttering if feedback control were used, since it would be necessary to read the feedback signals without exposing the film 5.

The described recording system is that of a photographic film transport arrangement, but there are other systems which could be used. For example, the image plane could be located at the surface of a selenium drum printer, or the screen of a vidicon tube. The latter would permit not only printing from a suitable high intensity cathode-ray tube, but would also enable a running line display of the output to be provided for monitoring purposes or for use in telegraphic communication systems.

It will be observed that the illustrated embodiment enables 250,000 symbols to be stored for random access printout within the worst-case tracking time for one co-ordinate. To provide this capability by digital storage of graphic images would require a storage capability of the order of 1,000 megabytes for the most rudimentary character forms, and for a repertoire of acceptable print styles would require an increase of at least one, and possibly two orders of magnitude, thus putting a demand of at least 10,000 and possibly 100,000 megabytes on storage capacity. According to the described embodiment, it is possible to replace a $10^{10}$ or $10^{11}$ byte store by a single optical store operating on 7-digit binary numbers, and to handle any graphic form required, governed only by artwork considerations.

The use which is made of the image format is dependent upon the application of a particular machine, but the following possibilities exist:

1. To include a shift from "lower case" to "upper case." This could cover not only the normally accepted function of such a shift in relation to any alphabetic script employed, but could also cover a shift from old-style to simplified Chinese characters or from Japanese Katakana to the corresponding Hirugana syllabary.

2. Where alphabetic scripts involve selection of ligatures in context, simple computation could be used automatically to select the correct variant from a number in a given image field.

3. In the case of large-repertoire Chinese work, any image field could be used for two or more different characters (in a correspondingly restricted range of variations) thereby multiplying the reportoire to 20,000 separate characters or more. Obviously the input would be specifically encoded to ensure the correct shifts in this case.

Although the primary application of the present invention is to ideographic systems, it can nevertheless be used in any writing system where it is inconvenient to move a matrix in order to select individual direct optical images.

The techniques necessary for making holograms of the kind described are known to those skilled in the art of holography, and will not be described further here except to state that the highest possible resolution should be sought, for example by using thermal or electrostatic deformation to produce high efficiency phase holograms, and taking the best means known to eliminate speckle in their production.

I claim:

1. A character matrix for an optical printing or typesetting machine which matrix comprises a plurality of holograms each of which stores an image containing print symbols and control signals.

2. A matrix according to claim 1 wherein said control signals are position control signals.

3. A matrix according to claim 2 wherein said control signals represent more than one stage of control.

4. A matrix according to claim 1 wherein said control signals include parity bits.

5. A matrix according to claim 1 in which said control signals include an exposure control signal.

6. An optical printing or typesetting machine for ideographic writing systems comprising in combination (a) a source of substantially monochromatic radiation, (b) a deflector system which deflects radiation emanating from said source, (c) a character matrix which is fixed relative to said source during printing or setting of a symbol and which includes a plurality of holograms each of which when illuminated by radiation emergent from said deflector system causes the reconstruction at a common image field of a character image consisting of an array of symbols, (d) control means controlling said deflector system to direct radiation selectively towards any one of said plurality of holograms, (e) a receptor settable to respond to any one of a given number of distinct regions of said common image field and thereby receive a given symbol of the corresponding array upon illumination of any one of said holograms, (f) a shift mechanism which controls the setting of said receptor, and (g) composing means coupled to said receptor.

7. A machine according to claim 6 wherein said shift mechanism is actuated by a font selector.

8. A machine according to claim 6 wherein said shift mechanism is actuated by an upper/lower case selector.

9. A machine according to claim 6 wherein said shift mechanism is actuated by a vocabulary selector.

10. An optical printing or typesetting machine for ideographic writing systems comprising in combination (a) a source of substantially monochromatic radiation, (b) a deflector system which deflects radiation emanating from said source, (c) a character matrix which is fixed relative to said source during printing or setting of a symbol and which includes a plurality of holograms each of which when illuminated by radiation emergent from said deflector system causes the reconstruction at a common image field of a character image consisting of an array of symbols, (d) control means controlling said deflector system to direct radiation selectively towards any one of said plurality of holograms, (e) a receptor settable to respond to any one of a given number of distinct regions of said common image field and thereby receive a given symbol of the corresponding array upon illumination of any one of said holograms, (f) composing means coupled to said receptor, and (g) a control signal detector located in said common image field and operatively connected to said control means.

11. A machine according to claim 10 wherein said control signal detector and said control means include a parity channel.

12. A machine according to claim 10 wherein said control means exerts more than one stage of control on said deflector system.

13. A character matrix for use in an optical printing or typesetting machine as claimed in claim 6 which matrix includes a plurality of individual holograms set out in a two-dimensional array, each hologram of said plurality storing information corresponding to an image consisting of a respective array of typographic symbols for printing or setting located at a common image field which is common to all the holograms of the plurality.

14. A matrix according to claim 13 wherein the different symbols in a given image are different graphic versions of a given character.

15. A matrix according to claim 13 wherein the different symbols include upper and lower case symbols.

16. A matrix according to claim 13 wherein the different symbols correspond to more than one character.

17. A character matrix for use in an optical printing or typesetting machine as claimed in claim 6 which matrix includes a plurality of individual holograms set out in a two-dimensional array, each hologram of said plurality storing information corresponding to an image consisting of a respective array of typographic symbols for printing or setting located at a common image field which is common to all the holograms of the plurality and in which each of said images further includes control signal indicia.

18. A matrix according to claim 17 wherein said control signals are positional control signals.

19. A matrix according to claim 18 wherein said control signals represent more than one stage of control.

20. A matrix according to claim 17 wherein said control signals include parity bits.

21. A matrix according to claim 17 in which said control signals includes an exposure control signal.

* * * * *